US009427862B1

(12) United States Patent
Durfee, Jr.

(10) Patent No.: US 9,427,862 B1
(45) Date of Patent: Aug. 30, 2016

(54) QUICK CONNECT AND ADJUSTMENT HAND IMPLEMENT SYSTEM

(71) Applicant: David L. Durfee, Jr., Meadville, PA (US)

(72) Inventor: David L. Durfee, Jr., Meadville, PA (US)

( * ) Notice: Subject to any disclaimer, the term of this patent is extended or adjusted under 35 U.S.C. 154(b) by 187 days.

(21) Appl. No.: 14/046,914

(22) Filed: Oct. 4, 2013

(51) Int. Cl.
*B25G 3/38* (2006.01)

(52) U.S. Cl.
CPC ..... *B25G 3/38* (2013.01)

(58) Field of Classification Search
CPC ..... B25G 3/12; B25G 3/14; B25G 3/24; B25G 3/30; B25G 3/38; B25G 1/02; B25G 1/06; B25B 23/0028
See application file for complete search history.

(56) References Cited

U.S. PATENT DOCUMENTS

| | | | | | |
|---|---|---|---|---|---|
| 152,952 | A * | 7/1874 | Mason | 403/58 | |
| 1,420,925 | A * | 6/1922 | Inghram | 15/146 | |
| 1,525,438 | A * | 2/1925 | Boone | 15/146 | |
| 1,550,841 | A * | 8/1925 | Pecota | 403/93 | |
| 1,800,349 | A * | 4/1931 | Hurason | 403/57 | |
| 2,013,963 | A * | 9/1935 | Ingling | 403/93 | |
| 2,446,401 | A * | 8/1948 | Ziskind | A47L 1/09 | 15/121 |
| 2,555,226 | A * | 5/1951 | Draughn | 403/73 | |
| 2,563,781 | A * | 8/1951 | Fry | 403/55 | |
| 2,763,517 | A * | 9/1956 | Strand | 403/58 | |
| 4,929,112 | A * | 5/1990 | Wilcox | 403/93 | |
| 5,810,408 | A * | 9/1998 | Armstrong | 294/57 | |
| 5,868,515 | A * | 2/1999 | Janssen | 403/97 | |
| 5,871,204 | A * | 2/1999 | Spirer | 254/26 R | |
| 6,155,620 | A * | 12/2000 | Armstrong | 294/57 | |
| 6,625,837 | B2 * | 9/2003 | Jiang | 15/105 | |
| 7,055,204 | B2 * | 6/2006 | Ajluni | A47L 1/06 | 15/121 |
| 7,464,440 | B2 * | 12/2008 | Decker | 16/422 | |
| 7,520,199 | B2 * | 4/2009 | Stawarski | 81/177.8 | |
| 7,682,099 | B2 * | 3/2010 | Cole | 403/97 | |
| 7,987,749 | B2 * | 8/2011 | Hsieh | 81/177.8 | |
| 8,056,445 | B2 * | 11/2011 | Jackson, III | 81/53.1 | |
| 8,511,207 | B2 * | 8/2013 | Su | 81/177.7 | |
| 8,595,884 | B2 * | 12/2013 | Tawara | 15/144.1 | |
| 8,708,312 | B2 * | 4/2014 | Stawarski | 254/129 | |
| 9,078,547 | B2 * | 7/2015 | Cheng | A47L 1/06 | 15/105 |
| 2002/0078518 | A1 * | 6/2002 | Jiang | 15/111 | |
| 2003/0009839 | A1 * | 1/2003 | Streutker et al. | 15/228 | |
| 2007/0214607 | A1 * | 9/2007 | Lin | 16/438 | |
| 2008/0178710 | A1 * | 7/2008 | Alvarado | 81/120 | |
| 2009/0169292 | A1 * | 7/2009 | LeCompte et al. | 403/100 | |
| 2010/0139459 | A1 * | 6/2010 | Jackson | 81/177.2 | |
| 2010/0186181 | A1 * | 7/2010 | Tawara | 15/144.4 | |
| 2011/0002732 | A1 * | 1/2011 | Su | 403/325 | |
| 2011/0056035 | A1 * | 3/2011 | Burbacki | A46B 5/0033 | 15/144.1 |
| 2012/0067164 | A1 * | 3/2012 | Su | 74/575 | |
| 2013/0175486 | A1 * | 7/2013 | Stawarski | 254/129 | |
| 2013/0205601 | A1 * | 8/2013 | Wu | 30/255 | |
| 2013/0327998 | A1 * | 12/2013 | Su | 254/129 | |
| 2014/0369739 | A1 * | 12/2014 | Bukovitz et al. | 403/66 | |
| 2015/0007404 | A1 * | 1/2015 | Prosser et al. | 15/144.1 | |

* cited by examiner

*Primary Examiner* — David B Thomas
(74) *Attorney, Agent, or Firm* — Richard K Thomson

(57) ABSTRACT

A hand tool is provided with a mechanism which permits the handle of a hand tool to be adjusted through a wide array of angles relative to the implement to which it is attached to accommodate different sized users and uses of the tool. Further, a quick connect apparatus permits any of a plurality of hand tools to be connected to a single handle.

8 Claims, 27 Drawing Sheets

QUICK CONNECT AND ADJUSTMENT HAND IMPLEMENT SYSTEM

Applicant claims the benefit of provisional patent application Ser. No. 61/709,791 filed Oct. 4, 2012; Ser. No. 61/897,155 filed Jul. 17, 2013; and, 61/877,253 filed Sep. 12, 2013. Each of these documents is hereby incorporated by reference.

BACKGROUND AND SUMMARY OF THE INVENTION

The present invention is directed to the field of hand tools. More particularly, the present invention is directed to apparatus to enable quick change, as well as quick adjustment of hand implements including, but not limited to, spades, coal shovels, snow shovels, hoes, rakes, scrapers, snow rakes.

A large variety of hand tools have been developed to assist the user in performing a variety of tasks. While diversity here is good, it creates several problems which the present invention has been designed to address. First, standard hand implements are non-adjustable. Accordingly, although a particular individual having a specific height might be better accommodated by a particular tool handle-to-implement angle, s/he will have to make do with the same angle as everyone else. The hand implement system of the present invention allows adjustment through a wide range of angles to accommodate user height, build, work-angle preferences, and specific requirements of individual tasks. For example, on one occasion, a hoe may best be provided with a first angle to accomplish soil preparation and on the next occasion, a second different angle may be more suitable for creating furrows for planting seeds. Second, all these different items require separate independent storage. The present invention includes a single handle with quick-change capability to accommodate the various implements to accomplish the particular tasks. Most preferably, the quick adjustment mechanism and quick change apparatus will be used together.

A first aspect of the present invention is directed to a quick adjustment mechanism for use in altering a handle-to-implement angle easily and quickly, the mechanism including: a) a first element secured to a handle; b) a second element secured to an implement, one of the first and second elements comprising a toothed member; c) fixation means associated with the other of the first element and the second element engaging the toothed member to prevent relative angular movement between the first element and the second element; d) a mechanism to permit the fixation means to be disengaged from the toothed element, whereby the first element and the second element may be angularly moved to adjust the handle-to-implement angle. Preferably, the toothed member comprises at least one spline. In one preferred embodiment, the toothed member comprises two separate splines. In yet another embodiment, the spline includes a non-toothed cylindrical portion adjacent to a row of teeth on the spline. In several of the embodiments, the fixation means comprises a second toothed member engaging the spline. In at least one of the preferred embodiments, a push button is used to move the non-toothed cylindrical portion into alignment with the second toothed member permitting relative rotation between the first element and the second element.

Another aspect of the invention features a quick-connect apparatus for securing any of a plurality of implements to a handle, the quick-connect apparatus comprising: a) first connection means affixed to the handle; b) second connection means affixed to each of the implements; c) a securement bolt for sandwiching one of the first and second connection means to retain the implement on the handle. The apparatus further includes a quick-change clamp for sandwiching the one of the first and second connection means with the other of the second and first connection means. The quick-change clamp includes a protruding alignment boss for preventing relative rotation between the clamp and an element into which the alignment boss extends.

A third aspect of the invention features a hand tool that includes both a quick-connect apparatus and a quick-adjust mechanism, the hand tool including: a) a handle; b) a first element secured to the handle; c) an implement; d) a second element secured to the implement including means to releasably attach the second element to the first element; e) the first element having a first member which is adjustably positionable relative to a second member permitting a user to vary an handle-to-implement angle as desired.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
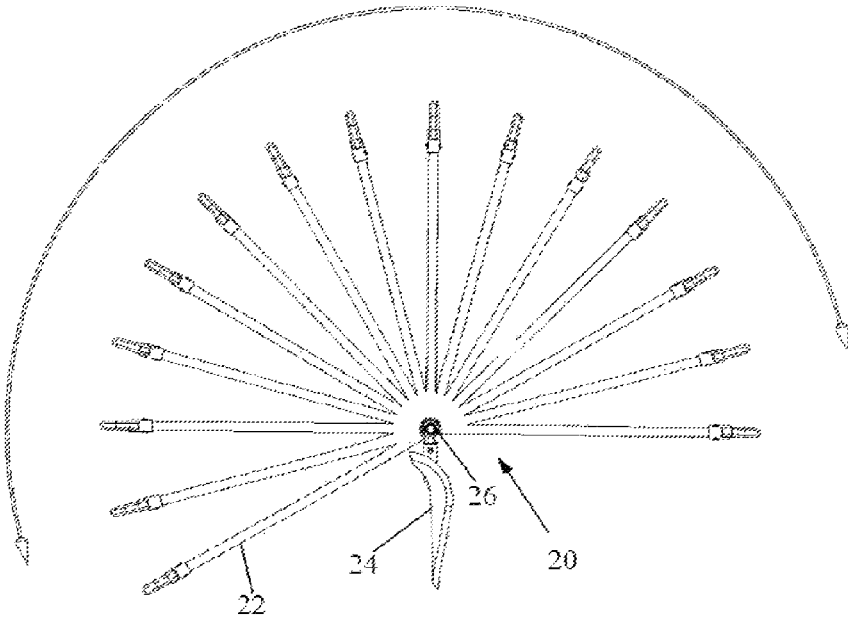
FIG. 1 is a schematic depiction of the extensive plurality of positions which the adjustment feature of the present invention may accomplish.
Figure 2:
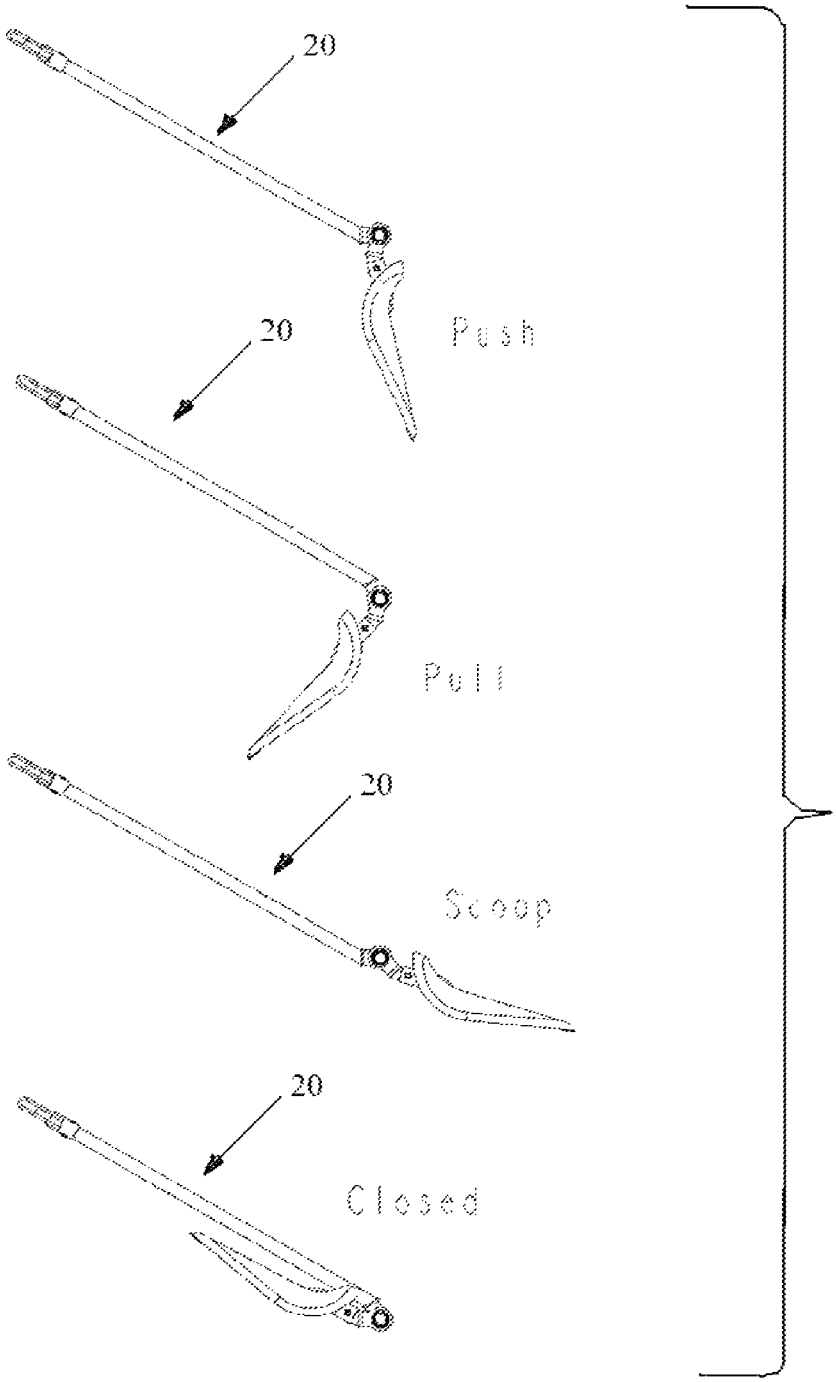
FIG. 2 is a schematic depiction of several implements which can utilize the universal handle of the present invention.
Figure 3A:
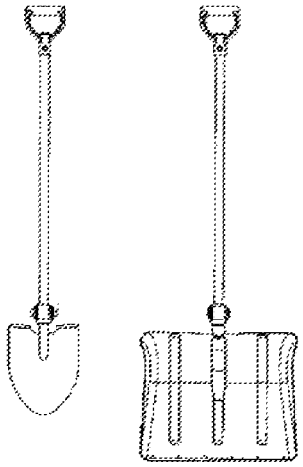
FIG. 3A is a front view of two styles of shovels employing the features of the present invention.
Figure 3B:
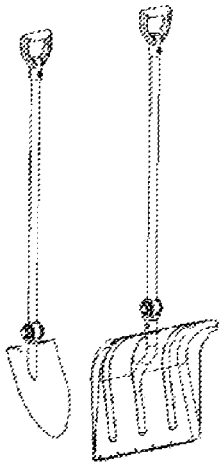
FIG. 3B is a front perspective view of those two styles of shovels.
Figure 3C:
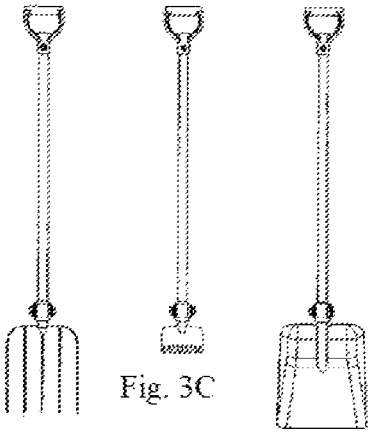
FIG. 3C is a front view of two other tools which employ the features of the present invention.
Figure 3D:
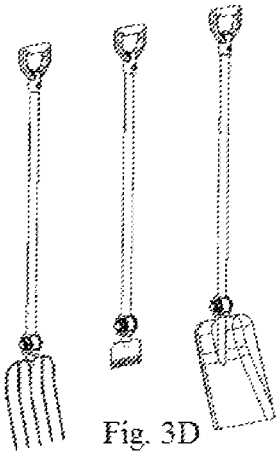
FIG. 3D is a front perspective view of those other tools.
Figure 3E:
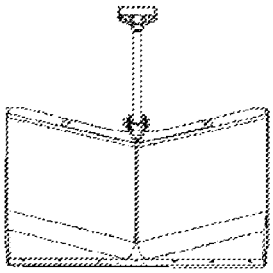
FIG. 3E is a front view of a snow rake employing the features of the present invention.
Figure 3F:
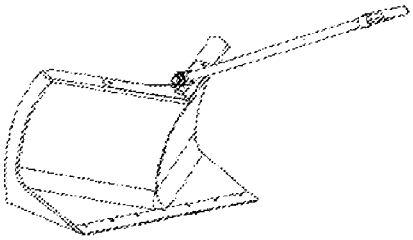
FIG. 3F is a front perspective view of the snow rake of FIG. 3E.

A first embodiment of the quick adjustment system of the present invention is depicted in FIGS. 1-2 generally at 20. FIG. 1 schematically depicts a plurality of positions which the adjustment mechanism 26 permits between handle 22 and implement 24 (in this embodiment a shovel). As set forth in FIGS. 2 and 3A-3F, the adjustment mechanism may be employed with various implements including, but not limited to spades, coal shovels, snow shovels, hoes, rakes, scrapers, snow rakes. As shown in these figures, the adjustment mechanism may be independently utilized with each of these implements. More preferably, however, the adjustment mechanism and the quick change apparatus 52 will be jointly employed for maximum benefit.

Figure 4A:
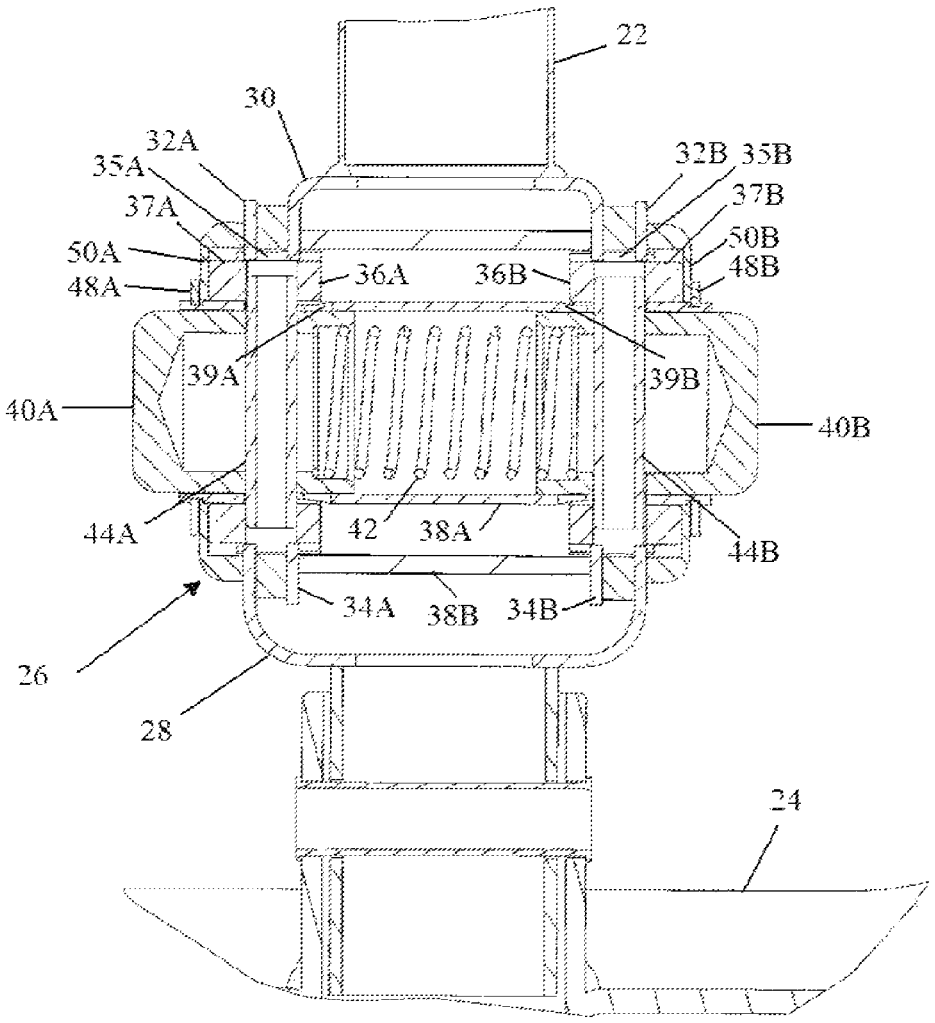
FIG. 4A is a cross-sectional front view of a first embodiment of the adjustment mechanism of the present invention in locked position.
Figure 4B:
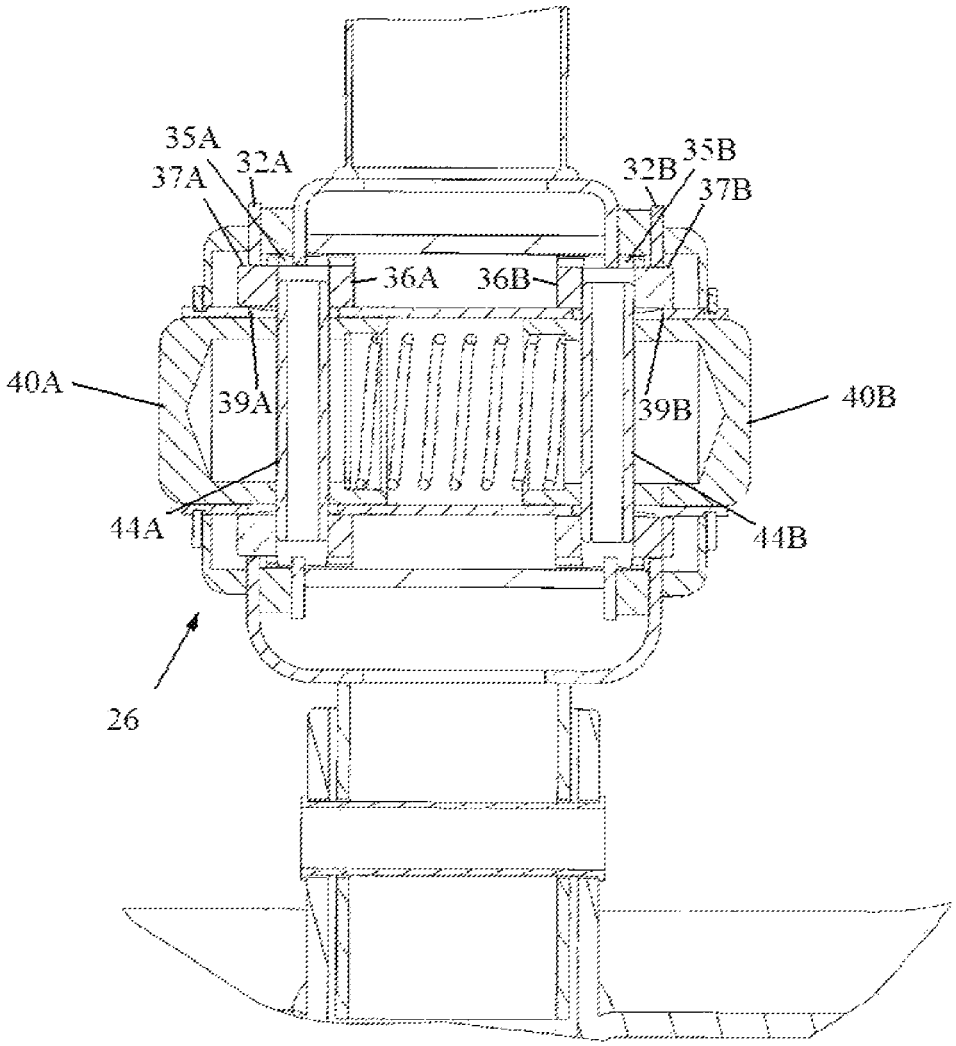
FIG. 4B is a cross-sectional front view of a first embodiment of the adjustment mechanism in unlocked position.
Figure 5:
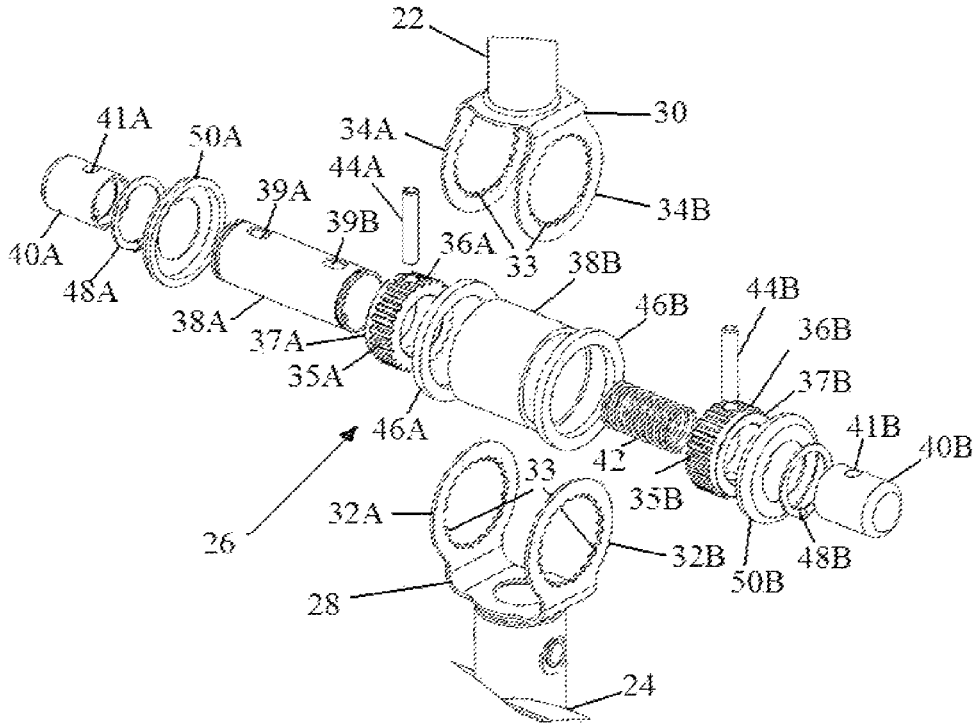
FIG. 5 is an exploded perspective view of the adjustment mechanism shown in FIG. 4A.

A first preferred embodiment of the adjustment mechanism 26 of the present invention is depicted in FIGS. 4A, 4B and 5. A first lower clevis 28 is attached to implement 24 while the upper clevis is attached to handle 22. It will be understood that the function of adjustment mechanism 26 is to permit angular adjustment between the handle 22 and the implement 24 to enhance the effectiveness of the tool for a particular individual or task. Lower clevis 28 includes a left (as viewed in the figures) arm 32A and a right arm 32B while upper clevis 30 includes a left arm 34A and a right arm 34B. The arms 34A and 34B are designed to fit inside the outer lateral extent of arms 32A and 32B. Each of the arms 32A, 32B, 34A, and 34B has a large toothed opening 33.

Inner sleeve 38A extends through a center portion of adjustment mechanism 26 while outer sleeve 38B overlies a majority of the mechanism and serves as a protective cover, keeping out dirt, debris and other objects that could interfere with its operation. Two slotted throughbores 39A and 39B are formed in the inner sleeve 38A. Left (35A) and right (35B) splines overlie inner sleeve 38A while left and right activating push buttons 40A and 40B extend into its interior such that circular holes 41A and 41B align with slotted throughbores 39A and 39B, respectively. Left and right splines have toothless cylindrical portions 37A and 37B extending on an outwardly extending portion adjacent their splines. Retention pins 44A and 44B extend through splines 35A and 35B, slotted throughbores 39A and 39B and holes 41A and 41B to unify these elements. Coil spring 42 engages shoulders internal to push buttons 40A and 40B to bias them to an extended position. In the extended position, the teeth on splines 35A and 35B engage the teeth of openings 33 on each of clevis arms 32A and 34A and 32B and 34B, respectively. In this locked position, handle 22 and implement 24 are secured in a particular handle-to-implement alignment angle selected by the user. Spacers 46A and 46B (FIG. 5) are positioned between the ends of outer sleeve 38B and end caps 50A and 50B, respectively, while retainer rings 48A and 48B fit in annular recesses in the ends of inner sleeve 38A to secure the assembly of the mechanism 26.

As best seen by examining the differences between the locked position in FIG. 4A and the unlocked position shown in FIG. 4B, when activating push buttons 40A and 40B are engaged compressing coil spring 42, slotted throughbores 39A and 39B permit retention pins 44A and 44B to move to an inner position where the toothless cylindrical portions 37A and 37B of splines 36A and 36B are inside toothed openings 33 of left and right clevis arms 28A and 28B creating an unlocked condition in which the handle-to-implement angle may be adjusted to suit the user and/or the application. When push buttons 40A and 40B are released, the handle-to-implement angle will be locked in the newly selected position.

Figure 6:
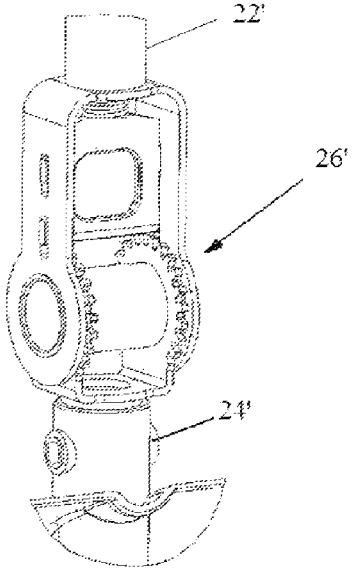
FIG. 6 is a front perspective view of a second embodiment of adjustment mechanism.
Figure 7:
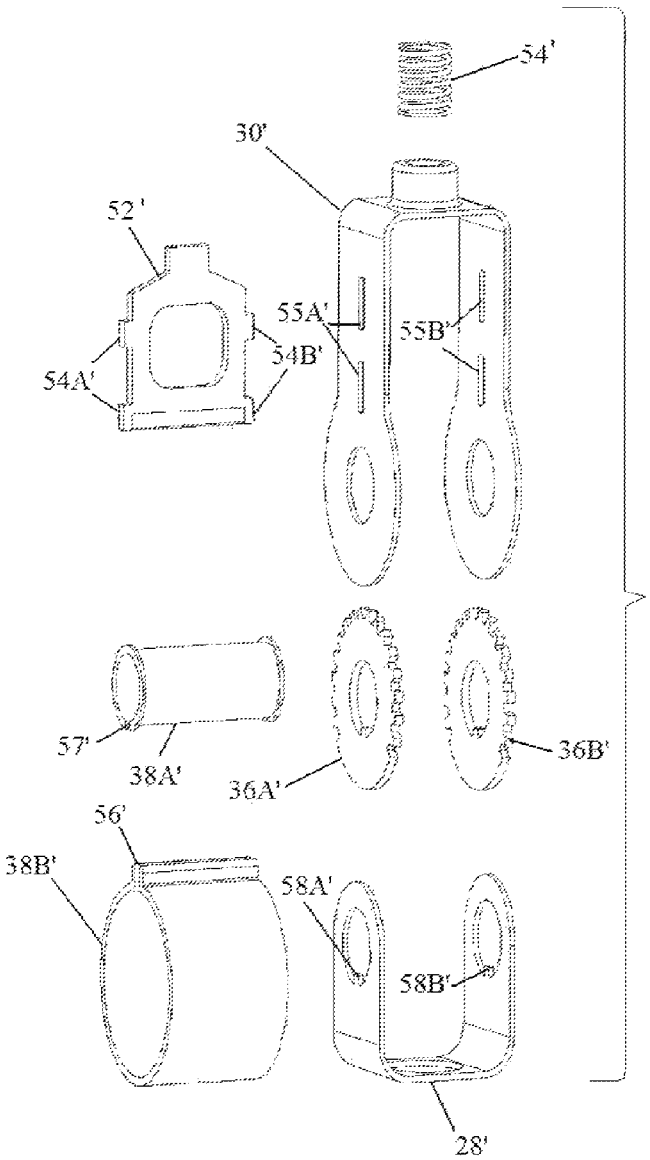
FIG. 7 is an exploded perspective view of the adjustment mechanism shown in FIG. 6.

A second embodiment of the adjustment mechanism of the present invention is shown in FIGS. 6 and 7 generally at 26'. The inner peripheries of lower and upper devises 28' and 30' are smooth in this embodiment. Inner sleeve 38A' is formed with a keyway 57' which maintains in alignment keys 36C' and 36D' of adjustment splines 36A' and 36B', respectively, with keys 58A' and 58B' of clevis 28'. Outer protective sleeve 38B' is optional and may be omitted without affecting the operation of the device, but may be included to protect the mechanism 26', keeping out dirt, debris and other objects that could interfere with its operation. It will be appreciated that when outer sleeve 38B' is omitted, the teeth of splines 36A' and 36B' may be integrally formed on the top of arms of lower clevis 28' eliminating the extra pieces. Protective sleeve 38B' has a slot 56B' which receives the locking notch plate 56A' to allow its engagement with teeth of adjustment splines 36A' and 36B' to maintain a desired tool handle-to-implement angle. Locking plate 56A' has two pair of protruding tabs 54A' and 54B' which are received in slots 55A' and 55B', respectively to control movement of locking plate 56A'. To enable adjustment of said angle, locking notch plate 56A' is disengaged from the teeth of splines 36A' and 36B' by pulling locking notch plate against the bias of spring 54' (i.e., to the position shown in FIG. 6). Handle 22' may then be rotated relative to implement 24' and the new angle locked in by releasing notch plate 56A'.

Figure 8:
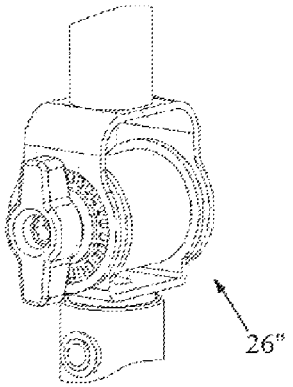
FIG. 8 is a front perspective view of a third embodiment of adjustment mechanism.
Figure 9:
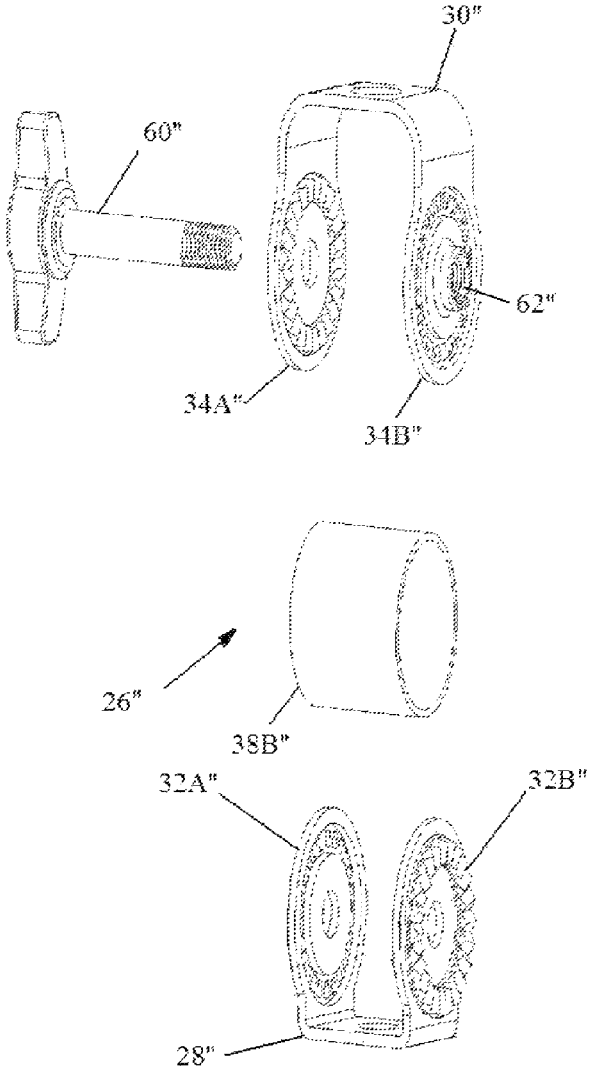
FIG. 9 is an exploded perspective view of the adjustment mechanism shown in FIG. 8.

A third embodiment of the adjustment mechanism of the present invention is shown in FIGS. 8 and 9 generally at 26". In this embodiment, the gear teeth are formed integrally with arms 32A", 32B", 34A", and 34B" with the teeth being formed on external faces of the arms of clevis 28" and on internal faces of the arms of clevis 30". Outer sleeve 38B" functions as a spacer to maintain alignment of the arms 32A", 32B", 34A", and 34B" as locking bolt 60" is threaded into integral nut 62". To allow rotation of the elements of adjustment mechanism 26", locking bolt 60" is loosened and the gear faces on arms 32A", 32B", 34A", and 34B" repositioned to the desired angle. Then, bolt 60" is retightened to secure adjustment mechanism 26" in place.

Figure 10A:
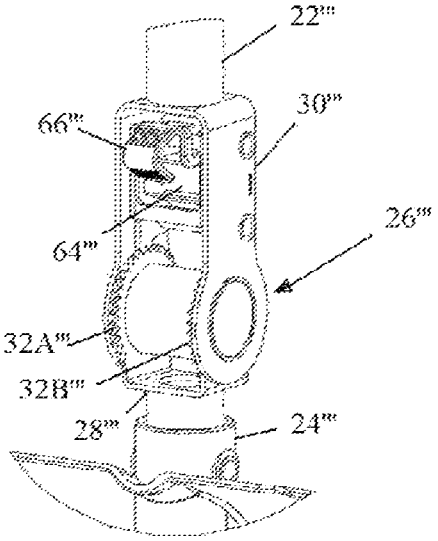
FIG. 10A is a front perspective view of a fourth embodiment of the adjustment mechanism.
Figure 10B:
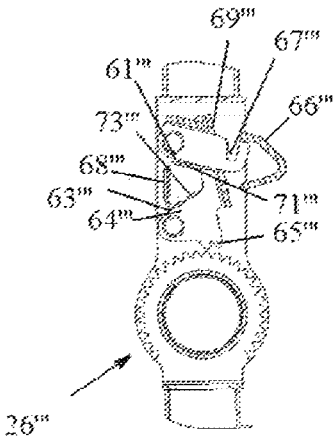
FIG. 10B is a cross-sectional side view of the adjustment mechanism shown in FIG. 10A.

A fourth embodiment of adjustment mechanism is shown generally in FIGS. 10A and 10B at 26'''. This embodiment features a first rocker arm 64''' and a second lock lever rocker arm 66'''. Gear teeth are formed on arms 33A''' and 33B'''. First rocker arm 64''' has tines 65''' which engage teeth on arms 33A''' and 33B'''. U-shaped spring 68''' has a first arm 63''' which engages surface 73''' of first rocker arm 64''' biasing it to rotate in a clockwise direction and a second spring arm 71''' which engages surface 61''' of rocker arm 66''' biasing it to rotate in a counterclockwise direction. Arm 69''' of rocker arm 64''' engages in recess 67''' of lock lever rocker arm 66''' retaining handle 22''' in locked position relative to implement 24'''. By depressing lock lever rocker arm 66''' (i.e., rotating it in a clockwise direction opposing the pressure of spring arm 61"), rocker arm 64''' is freed to allow tines 65''' to move freely relative to toothed arms 33A''' and 33B'''. When the desired handle-to-implement angle is reached, pressure on lock lever rocker arm 66''' is released and tines 65''' return to their rotation inhibiting engagement with the teeth of arms 33A''' and 33B'''.

Figure 11A:
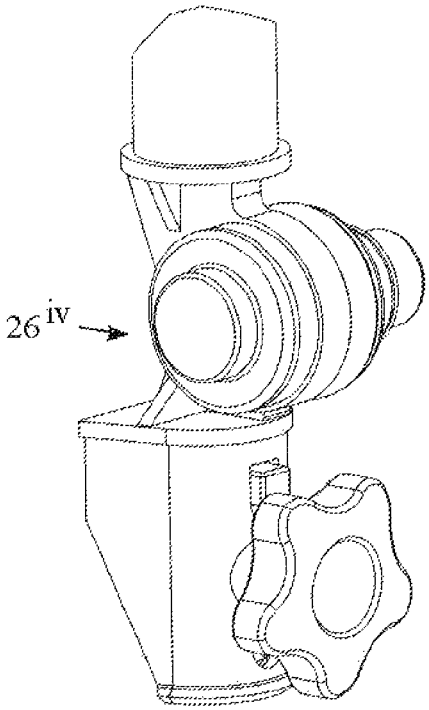
FIG. 11A is a front perspective view of a fifth embodiment of the adjustment mechanism.
Figure 11B:
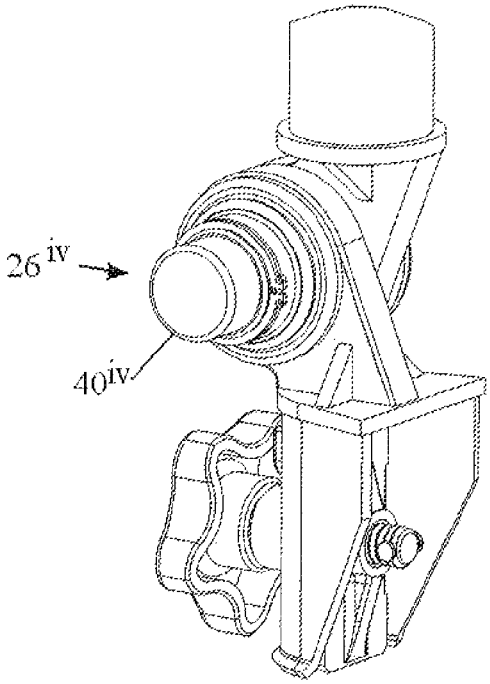
FIG. 11B is a rear perspective view of the embodiment shown in FIG. 11A.
Figure 11C:
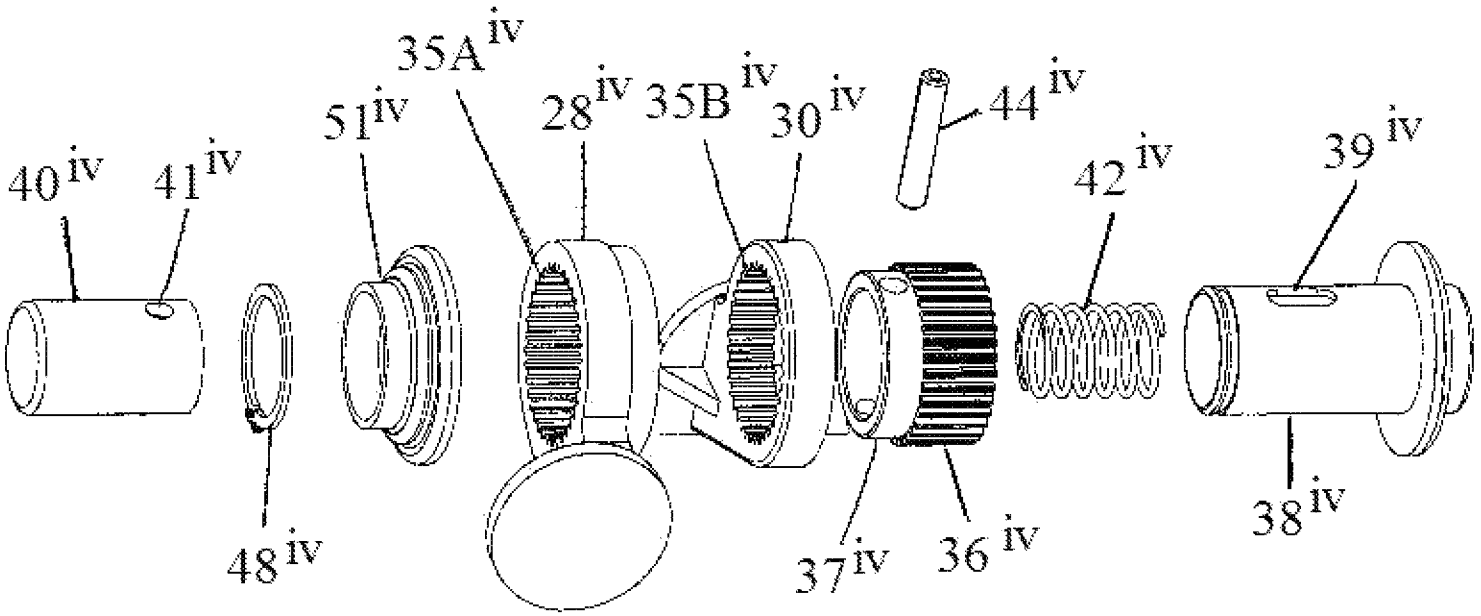
FIG. 11C is an exploded view of the embodiment shown in FIG. 11A.

A fifth embodiment of quick adjustment mechanism is shown in FIGS. 11A 11B and 11C at 26$^{iv}$. This embodiment features a single push button actuator 40$^{iv}$. The inner sleeve of the first embodiment is replaced by flanged main shaft 38' which has slot 39$^{iv}$. A single main gear 36$^{iv}$ partially extends into internally toothed top and bottom gear brackets 35A$^{iv}$ and 35B$^{iv}$ which replace devises 28 and 30 of the first embodiment and are attached respectively to the implement and the handle. Retention pin 44$^{iv}$ extends through the hole in the untoothed region 37$^{iv}$ of main gear 36$^{iv}$, the slot 39$^{iv}$ in main shaft 38$^{iv}$ and through aligned holes 41$^{iv}$ in push button actuator 40$^{iv}$ forming a unit of main gear 36$^{iv}$, push button actuator 40$^{iv}$ and retention pin 44$^{iv}$. Coil spring 42$^{iv}$ biases push button actuator 40$^{iv}$ to its extended position with retention pin 44$^{iv}$ occupying a left most position in slot 39$^{iv}$. When push button actuator 40$^{iv}$ is engaged, retention pin 44$^{iv}$ moves to the rightmost position slot 39$^{iv}$ disengaging main gear 36$^{iv}$ from the gear teeth of gear bracket 35A$^{iv}$ to permit the handle-to-implement angle to be adjusted, as in the other embodiments.

Figure 12:
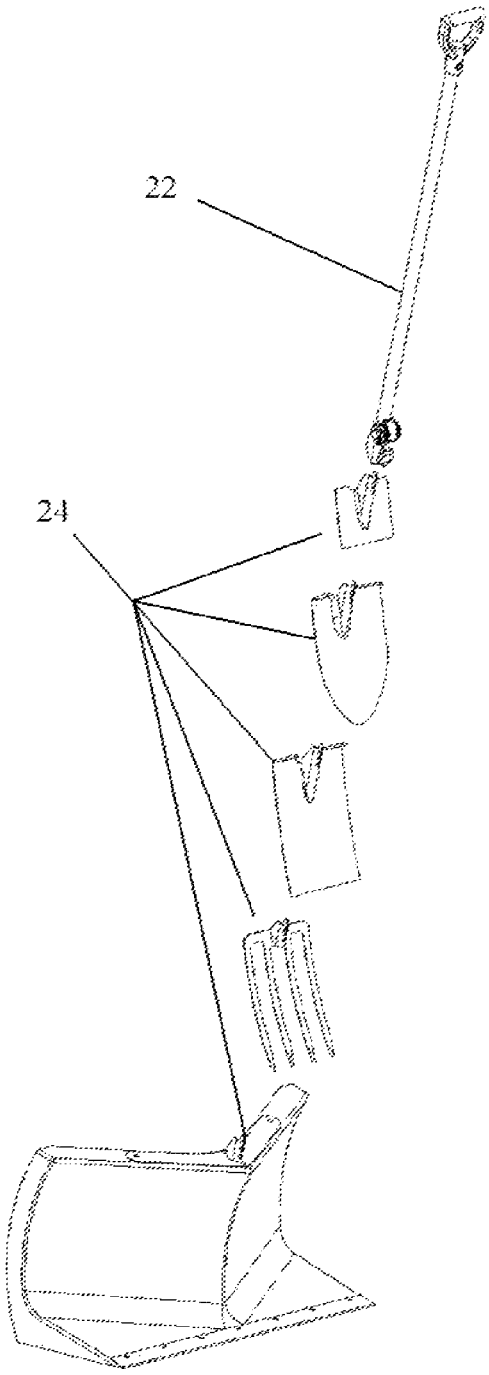
FIG. 12 is a schematic depiction of the quick change system with a plurality of different implements with which it may be used.
Figure 13:
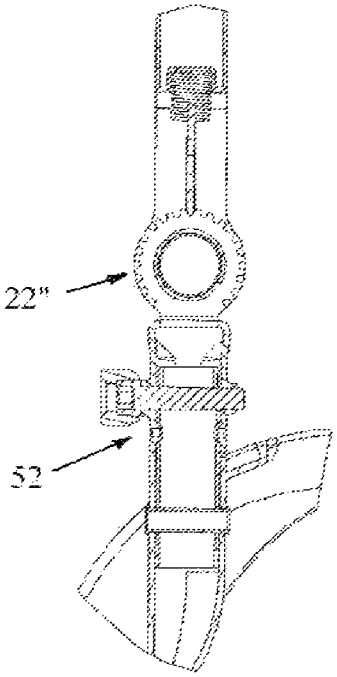
FIG. 13 is a cross-sectional side view of a first embodiment of the quick change system of the present invention.
Figure 14:
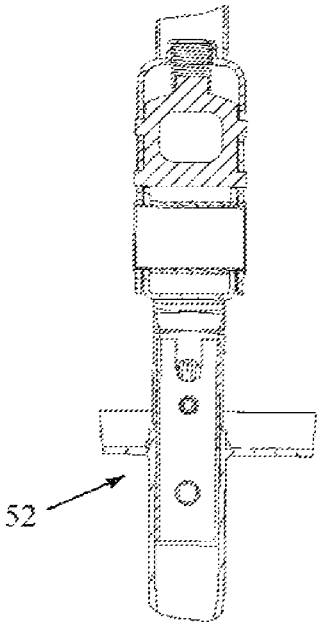
FIG. 14 is a cross-sectional side view of the first embodiment of the quick change system shown in FIG. 13.
Figure 15:
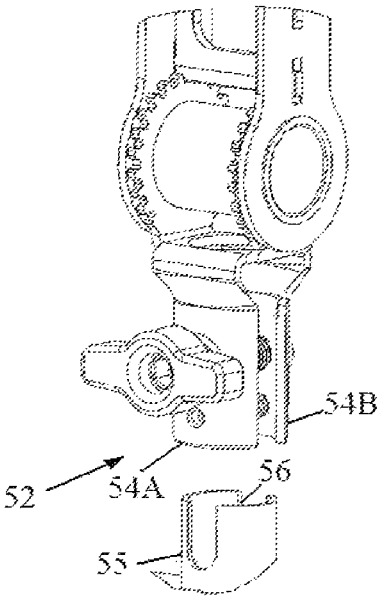
FIG. 15 is a front perspective view of the embodiment shown in FIG. 13.
Figure 16:
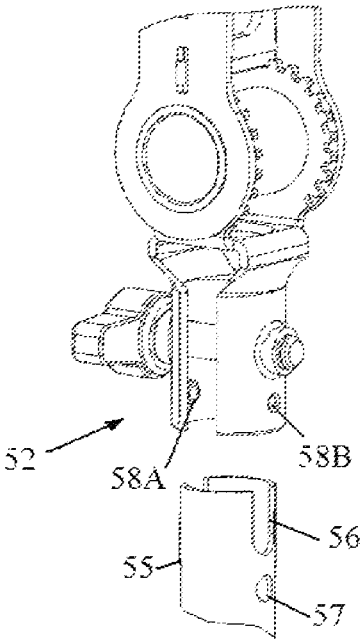
FIG. 16 is a side perspective view of the quick change system shown in FIG. 13.

FIG. 12 is a schematic depiction of the quick-change apparatus for attaching handle 22 to any of a plurality of implements 24. A first embodiment of quick-change apparatus is depicted generally at 52 in FIGS. 13-16. As depicted here, quick-change apparatus 52 is used with adjustment mechanism 22", although quick-change apparatus 52 may be married to any of the five adjustment mechanism embodiments disclosed herein. In this embodiment of quick-change apparatus 52, spring arms 54A and 54B are compressed by securement bolt 60 threading into captured nut 61 to clamp the upper end 55 of implement. Upper end 55 has a slot 56 which slides over bolt 60 while inwardly directed protrusions 58A and 58B engage in opposed holes 57 in upper end 55. Each of the implements 24 depicted in FIG. 12 will have an upper end 55 configured to be engaged by quick-change apparatus 52.

Figure 17A:
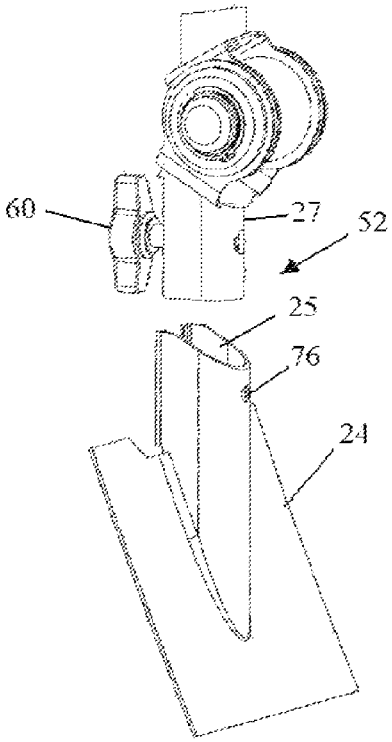
FIG. 17A is a front perspective view of a second embodiment of the quick change system of the present invention.
Figure 17B:
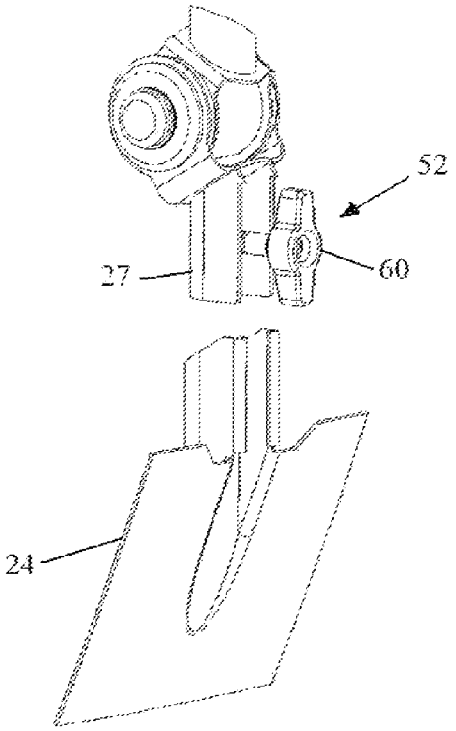
FIG. 17B is a rear perspective view of the quick change system shown in FIG. 17A.
Figure 17C:
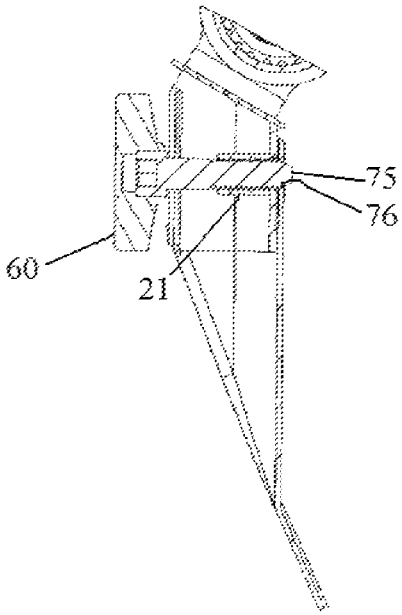
FIG. 17C is a cross-sectional side view of the quick change system shown in FIG. 17A.
Figure 17D:
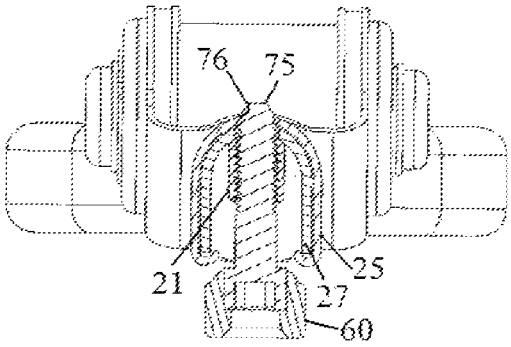
FIG. 17D is a cross-sectional top view of the quick change system shown in FIG. 17A.
Figure 18A:
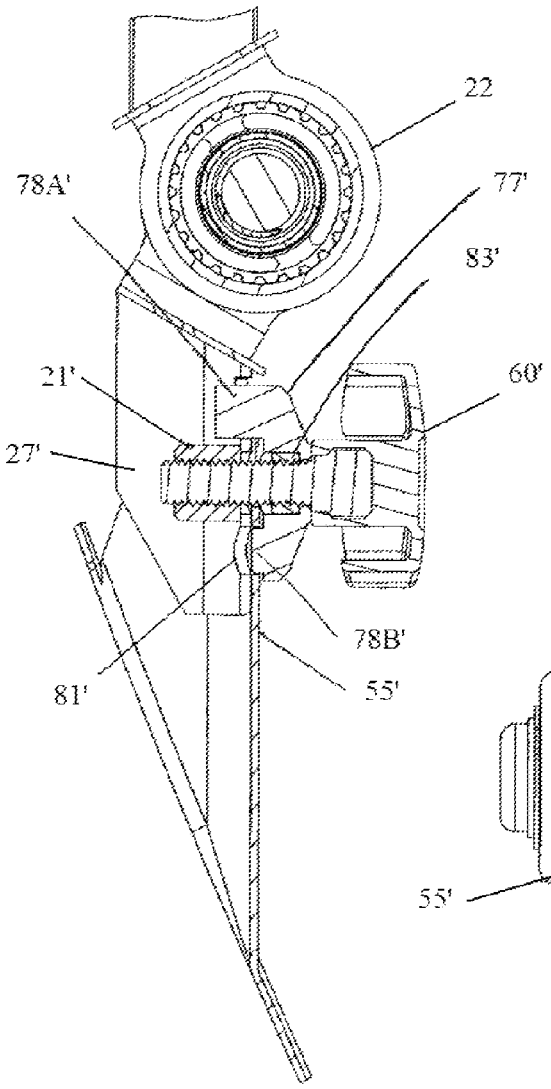
FIG. 18A is a cross-sectional side view of a third embodiment of the quick change system of the present invention.
Figure 18B:
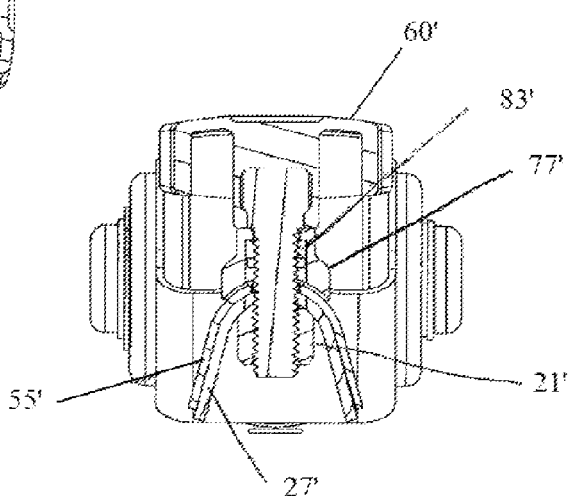
FIG. 18B is a top cross-sectional view of the quick-change system shown in FIG. 18A.
Figure 18C:
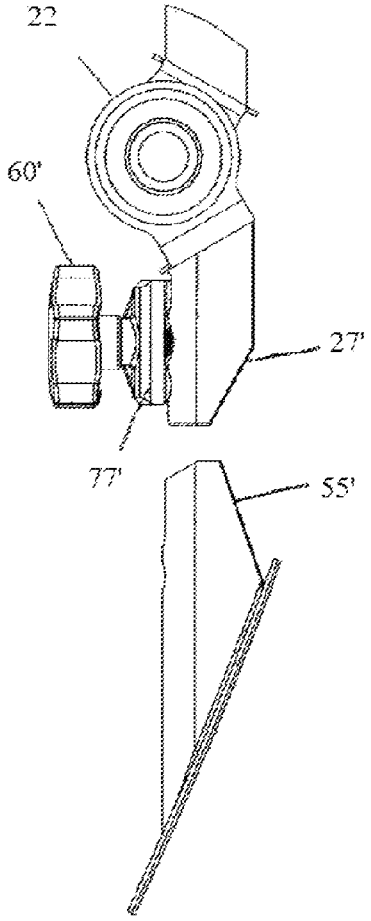
FIG. 18C is a side view with a portion omitted of the quick-change system shown in FIG. 18A.
Figure 18D:
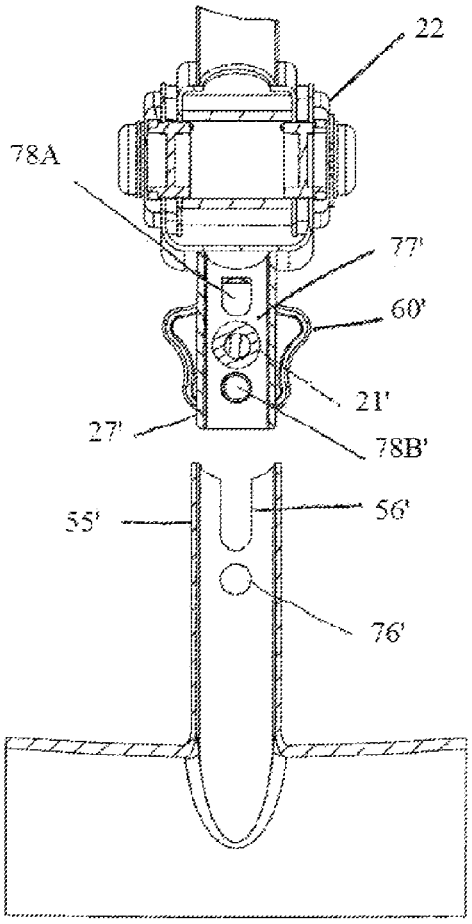
FIG. 18D is a cross-sectional rear view of the quick-change system shown in FIG. 18A.
Figure 18E:
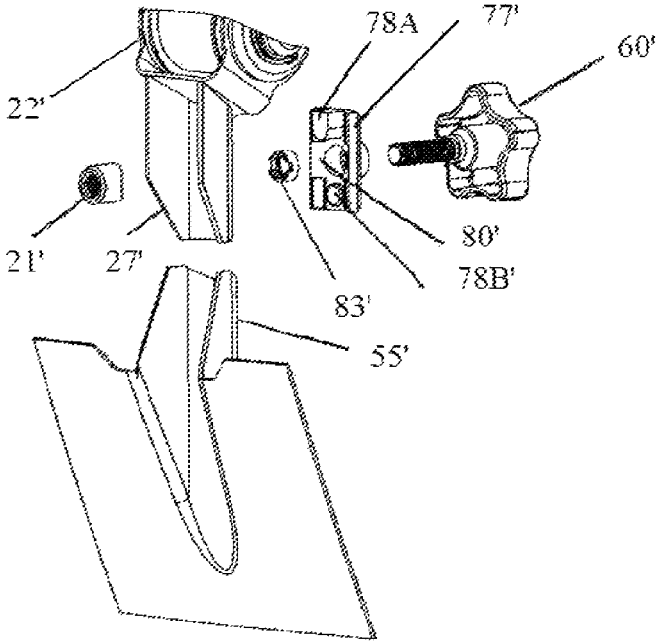
FIG. 18E is an exploded rear view of the quick-change system shown in FIG. 18A.
Figure 18F:
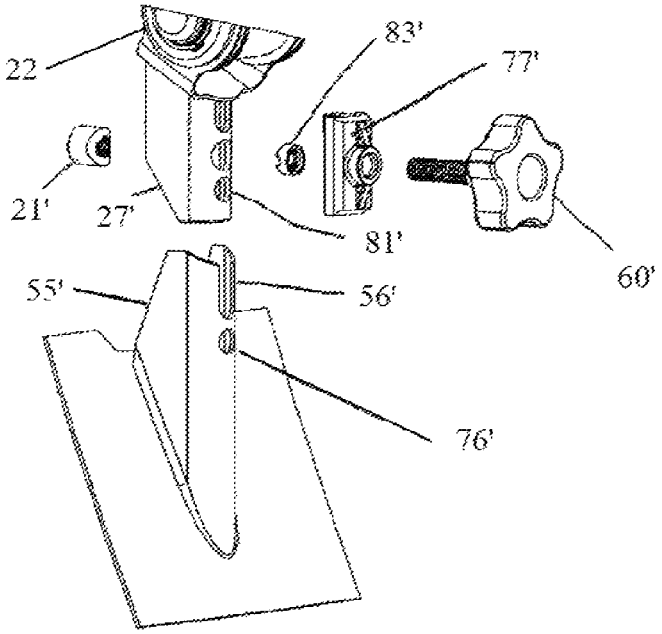
FIG. 18F is an exploded front view of the quick-change system shown in FIG. 18A.
Figure 19A:
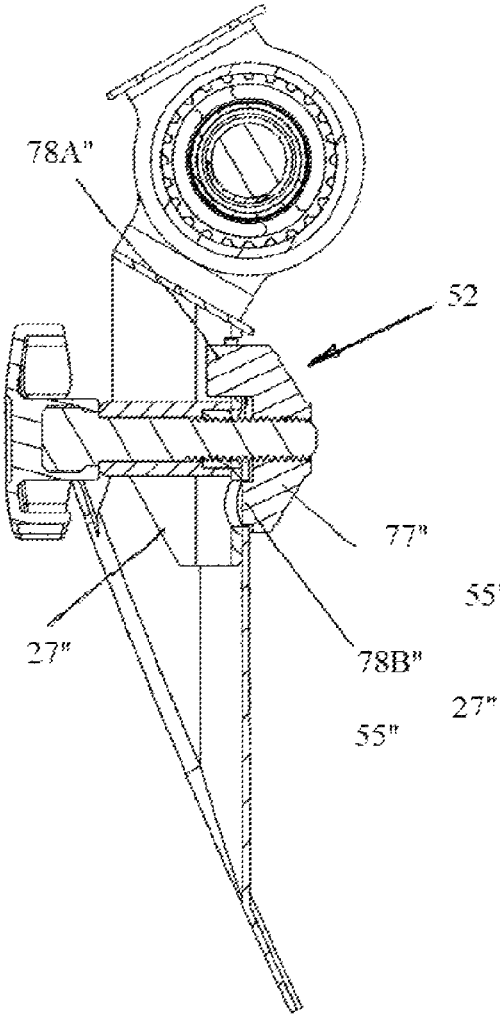
FIG. 19A is a cross-sectional side view of a fourth embodiment of the quick change system of the present invention.
Figure 19B:
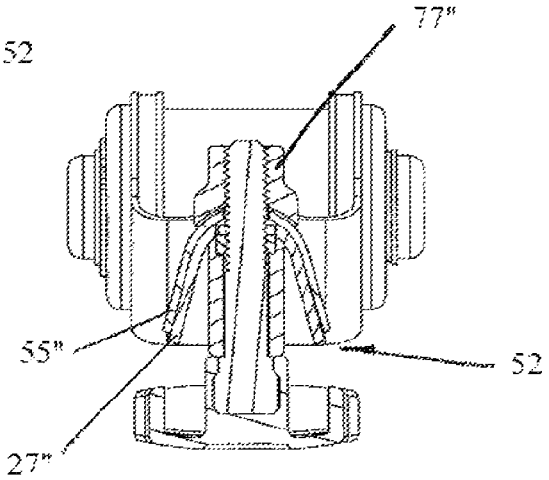
FIG. 19B is a top cross-sectional view of the quick-change system shown in FIG. 19A.
Figure 19C:
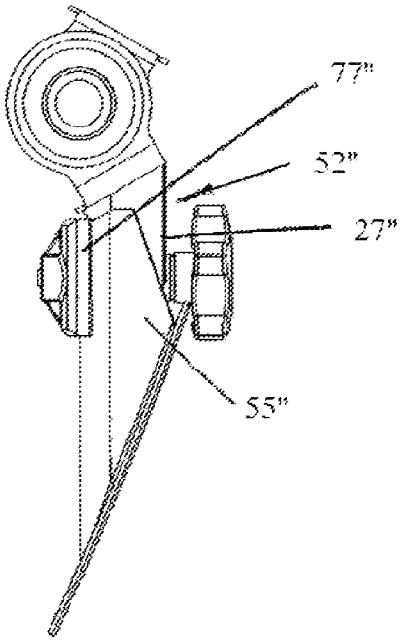
FIG. 19C is a side view with a portion omitted of the quick-change system shown in FIG. 19A.
Figure 19D:
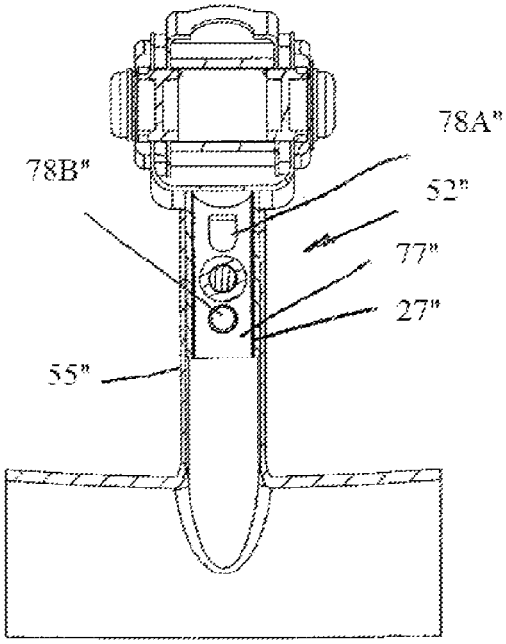
FIG. 19D is a cross-sectional rear view of the quick-change system shown in FIG. 19A.
Figure 19E:
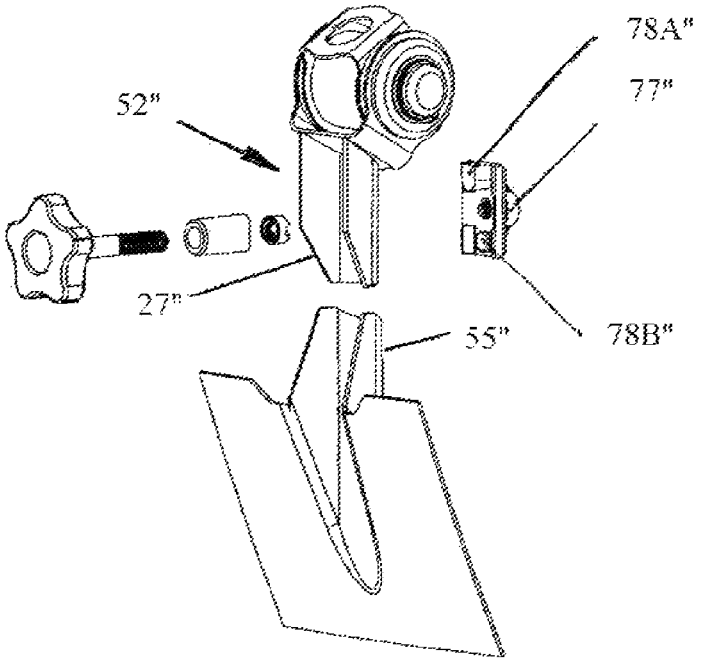
FIG. 19E is an exploded rear view of the quick-change system shown in FIG. 19A.
Figure 19F:
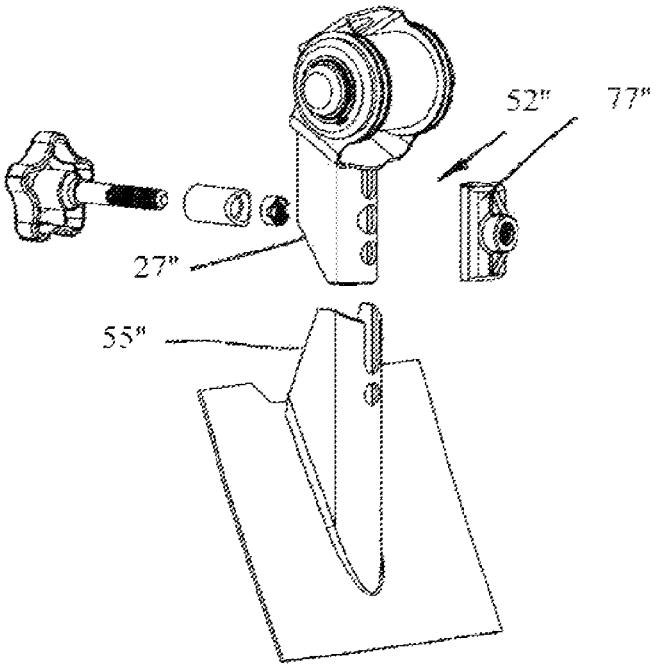
FIG. 19F is an exploded front view of the quick-change system shown in FIG. 19A.
Figure 20A:
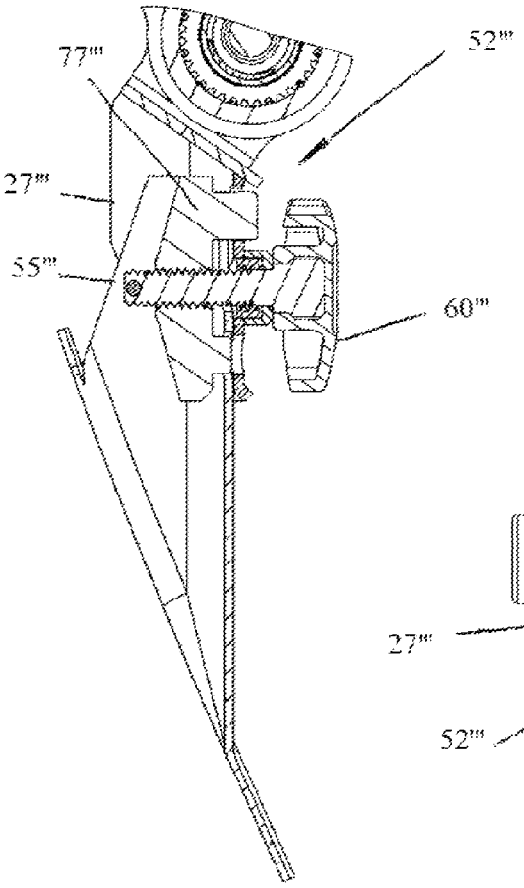
FIG. 20A is a cross-sectional side view of a fifth embodiment of the quick change system of the present invention.
Figure 20B:
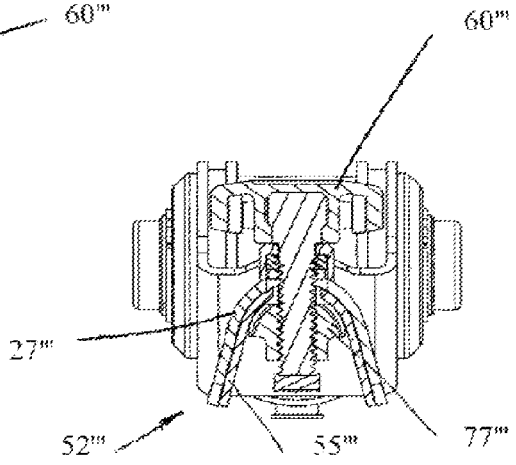
FIG. 20B is a top cross-sectional view of the quick-change system shown in FIG. 20A.
Figure 20C:
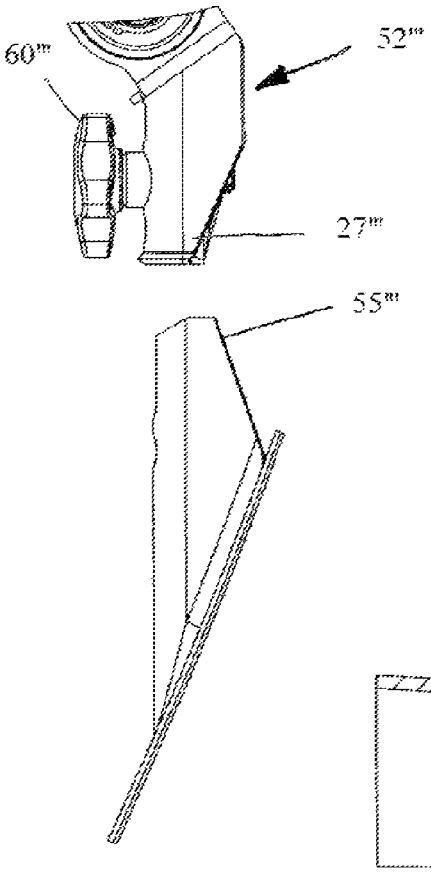
FIG. 20C is a side view with a portion omitted of the quick-change system shown in FIG. 20A.
Figure 20D:
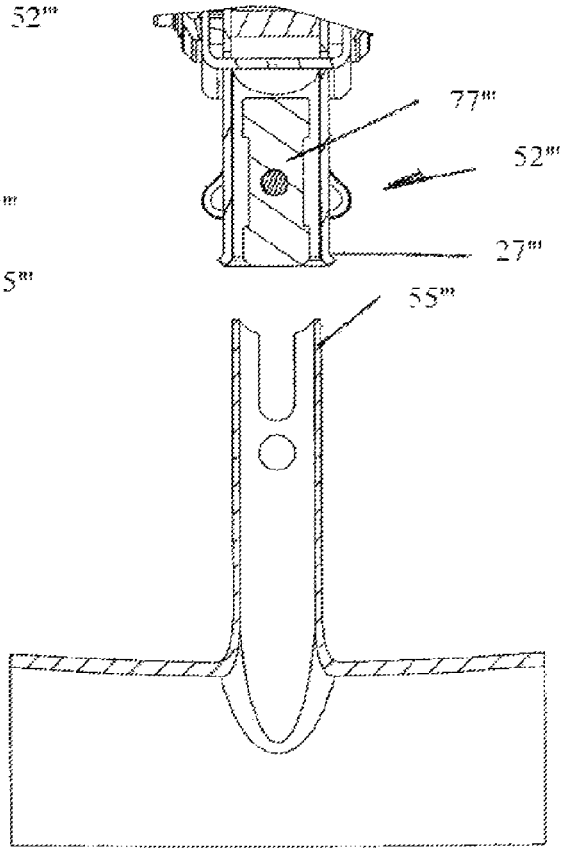
FIG. 20D is a cross-sectional rear view of the quick-change system shown in FIG. 20A.
Figure 20E:
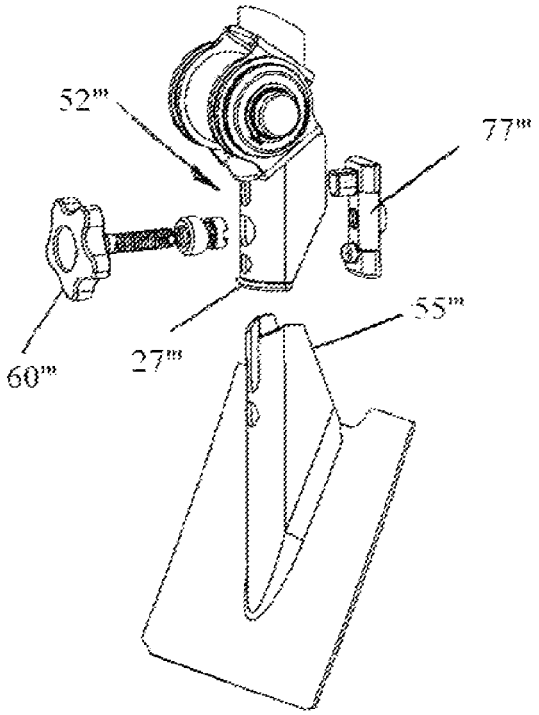
FIG. 20E is an exploded rear view of the quick-change system shown in FIG. 20A.
Figure 20F:
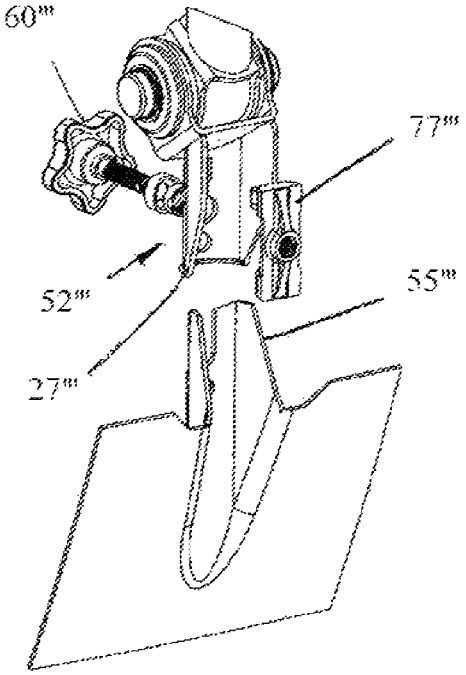
FIG. 20F is an exploded front view of the quick-change system shown in FIG. 20A.
Figure 21A:
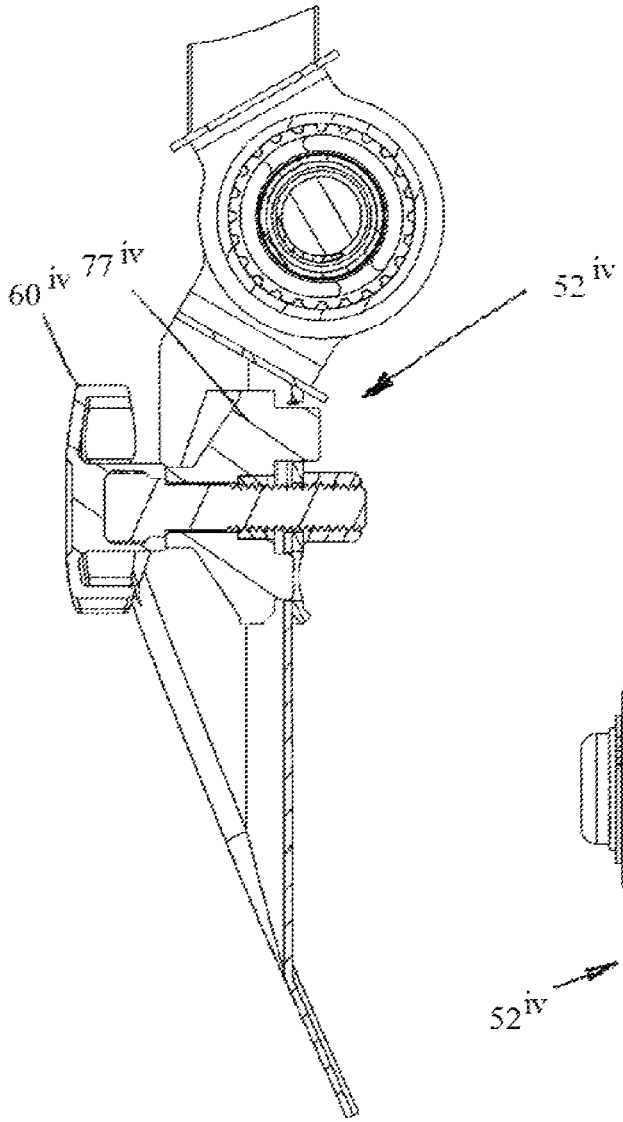
FIG. 21A is a cross-sectional side view of a sixth embodiment of the quick change system of the present invention.
Figure 21B:
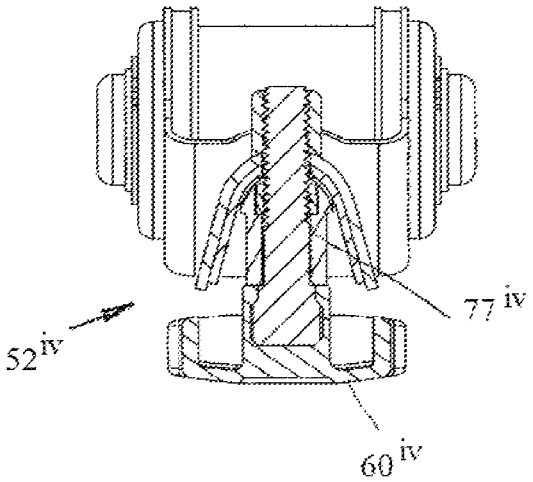
FIG. 21B is a top cross-sectional view of the quick-change system shown in FIG. 21A.
Figure 21C:
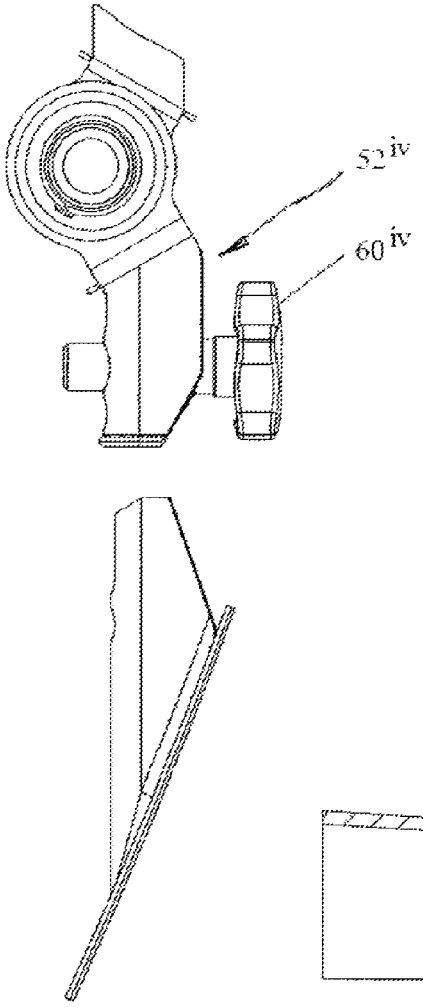
FIG. 21C is a side view with a portion omitted of the quick-change system shown in FIG. 21A.
Figure 21D:
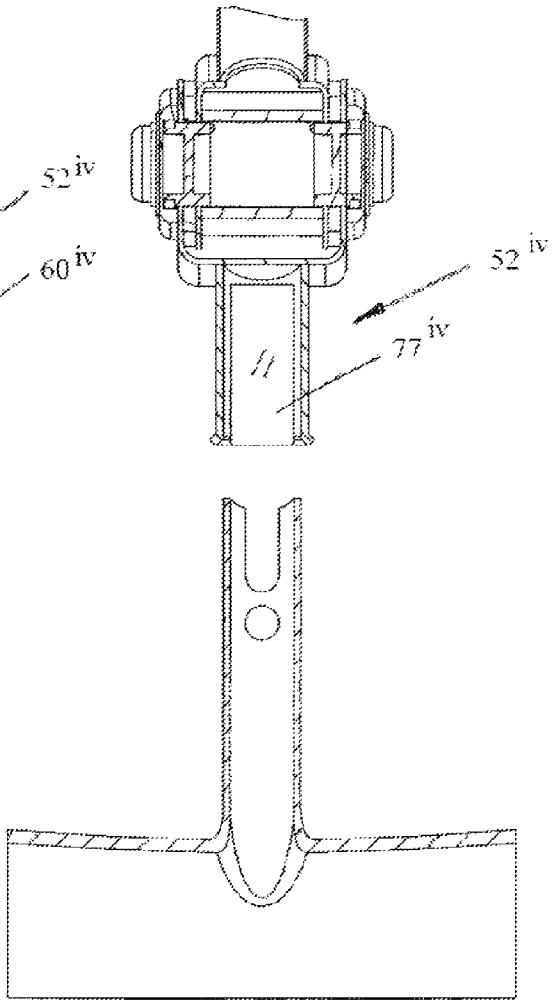
FIG. 21D is a cross-sectional rear view of the quick-change system shown in FIG. 21A.
Figure 21E:
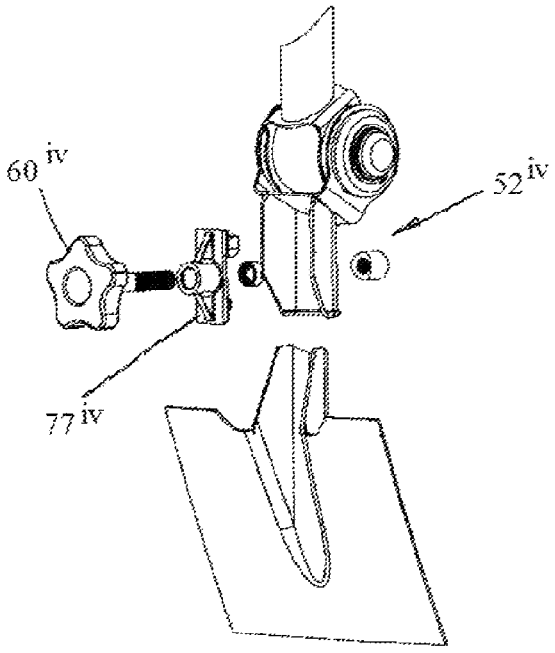
FIG. 21E is an exploded rear view of the quick-change system shown in FIG. 21A.
Figure 21F:
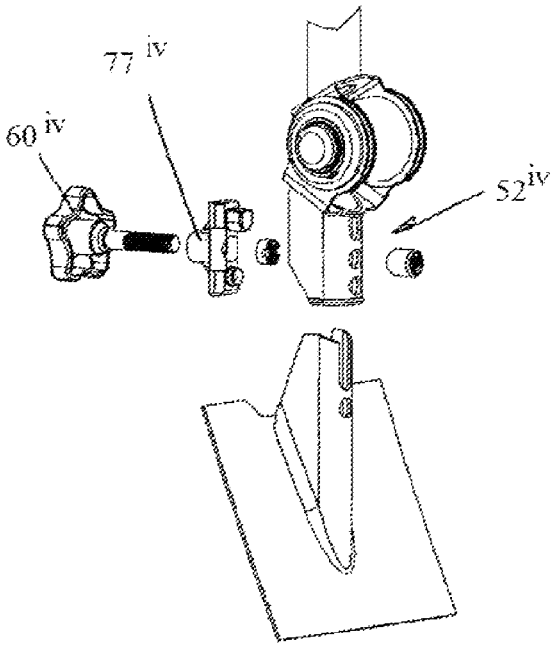
FIG. 21F is an exploded front view of the quick-change system shown in FIG. 21A.

A second embodiment of quick-change apparatus is depicted in FIGS. 17A-17D generally at 52. In this embodiment, the bottom end 27 of adjustment apparatus 22 is contoured with the implement 24 having a channel 25 which is complementary to contoured end 27. As seen in FIG. 17D, the captivated nut 21 in bottom end 27 is threadingly engaged by securement bolt 60 with the tip 75 of bolt 60 extending through hole 76 in channel 25. By loosening bolt 60 a turn or two, tip 75 is withdrawn from engagement with hole 76 allowing implement 24 to be removed and replaced with an alternate tool, as desired.

A third embodiment of quick-change apparatus is depicted in FIGS. 18A-F generally at 52'. In this embodiment, quick-change clamp 77' is used to sandwich the upper end 55' between the bottom end 27' of adjustment apparatus 22 and securement nut 21'. As in the previous embodiment, slot 56' in upper end 55' allows the passage of attachment bolt 60'. Quick change clamp 77' has a protruding alignment boss 78A' extending from a back side 80' and a securement boss 78B' that is received in hole 76' and extends into aligned hole 81' in bottom end 27' of adjustment apparatus 22. Screw retainer 83' is utilized to prevent attachment bolt 60' from being totally withdrawn from quick-change clamp 77'.

A fourth embodiment of quick-change apparatus is depicted in FIGS. 19A-F generally at 52". In this embodiment, the positions of the bottom end 27" and upper end 55" are reversed with the upper end 55" now being sandwiched between lower end 27" and quick-connect clamp 77". Alignment boss 78A" and securement boss 78B" function as in the previous embodiment.

A fifth embodiment of quick-change apparatus is depicted in FIGS. 20A-F generally at 52'". In this embodiment, the positioning of quick-connect clamp 77'" and securement bolt 60'" are reversed and the bottom end 27'" fitting inside upper end 55'" (see FIG. 20B).

Sixth embodiment of quick-change apparatus is depicted in FIGS. 21A-F generally at 52$^{iv}$. This embodiment is similar to the fourth embodiment depicted in FIGS. 20A-F, with quick-connect clamp 77$^{iv}$ positioned on the bolt 60$^{iv}$ side of the connection.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A quick adjustment mechanism for use between a handle which has a first longitudinal axis and an implement which defines a planar surface having a second longitudinal axis and a first lateral axis, said second longitudinal axis extending in a same general direction as said first longitudinal axis, said adjustment mechanism used for altering a handle-to-implement angle easily and quickly, the handle-to-implement angle being altered being the angle defined between said first longitudinal axis of said handle and said second longitudinal axis of said planar surface, said mechanism comprising:

a) a first element secured to a handle;

b) a second element secured to an implement, one of said first and second elements comprising a toothed member, said toothed member comprising at least one spline wherein said spline includes a first base diameter from which said teeth extend, a non-toothed cylindrical portion adjacent to a row of teeth on said spline, said non-toothed cylindrical portion having a second base diameter, said second base diameter equaling said first base diameter;

c) fixation means associated with the other of said first element and said second element engaging said toothed member to prevent relative angular movement between said first element and said second element;

d) a mechanism to permit said fixation means to be disengaged from said toothed element whereby said first element and said second element may be angularly moved to adjust the handle-to-implement angle.

2. The quick adjustment mechanism of claim 1 wherein said toothed member comprises two separate splines.

3. The quick adjustment mechanism of claim 1 wherein said fixation means comprises a second toothed member engaging said spline.

4. The quick adjustment mechanism of claim 3 further comprising a push button to move said non-toothed cylindrical portion into alignment with said second toothed member permitting relative rotation between said first element and said second element.

5. A quick-connect apparatus for securing any of a plurality of at least three implements to a handle, said quick-connect apparatus comprising:

a) first connection means affixed to the handle;

b) second connection means affixed to each of the at least three implements, each second connection means being identical in configuration;

c) a securement bolt for sandwiching one of said first and second connection means to retain the implement on the handle.

6. The quick-connect apparatus of claim 5 further comprising a quick-change clamp for sandwiching said one of said first and second connection means with said other of said second and first connection means.

7. The quick-connect apparatus of claim 6 wherein said quick-change clamp comprises a protruding alignment boss for preventing relative rotation between said clamp and an element into which said alignment boss extends.

8. A hand tool featuring both a quick-connect apparatus and a quick-adjust mechanism, said hand tool comprising:

a) a handle;

b) a first element secured to said handle;

c) a plurality of at least three implements capable of being attached to said handle;

d) a series of second elements, one each of said series being secured to each of said implements including means to releasably attach each of said second elements to said first element;

e) said first element having a first member which is engages and is adjustably positionable relative to a second member of each of said second elements permitting a user to vary an handle-to-implement angle as desired.

* * * * *